United States Patent [19]

Waymouth et al.

[11] 4,233,536

[45] Nov. 11, 1980

[54] INCANDESCENT LAMP GETTER

[75] Inventors: John F. Waymouth, Marblehead; Edmund M. Passmore, Gloucester; George L. Duggan, Bedford, all of Mass.

[73] Assignee: GTE Products Corporation, Stamford, Conn.

[21] Appl. No.: 970,294

[22] Filed: Dec. 18, 1978

[51] Int. Cl.[3] ..... H01K 1/56

[52] U.S. Cl. ..... 313/174; 313/222

[58] Field of Search ..... 313/222, 174

[56] References Cited

U.S. PATENT DOCUMENTS

| | | | |
|---|---|---|---|
| 1,566,848 | 12/1925 | Fonda | 313/222 X |
| 1,600,203 | 9/1926 | Campbell | 313/222 X |
| 1,651,387 | 12/1927 | Gustin | 313/222 X |
| 3,418,512 | 12/1968 | T'Jampens et al. | 313/222 X |
| 4,074,168 | 2/1978 | T'Jampens | 313/222 |
| 4,128,783 | 12/1978 | Giller et al. | 313/222 X |

*Primary Examiner*—Palmer C. Demeo

*Attorney, Agent, or Firm*—James Theodosopoulos

[57] ABSTRACT

An incandescent lamp comprises a glass envelope having a gas fill, a tungsten filament within the envelope, and getter means comprising carbon and hydrogen disposed within the envelope.

3 Claims, 1 Drawing Figure

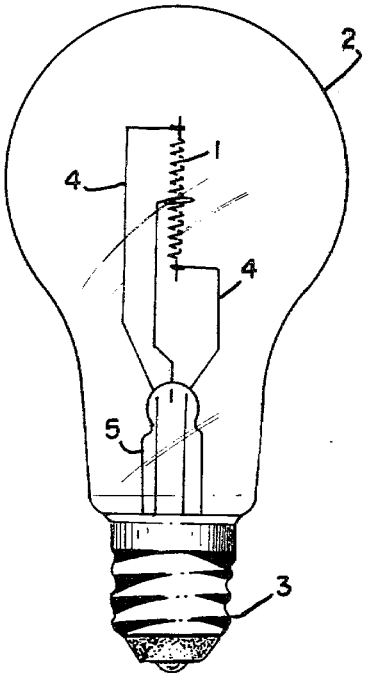
2
1
4
4
5
3

INCANDESCENT LAMP GETTER

THE INVENTION

This invention provides an improved getter, comprising carbon and hydrogen, for incandescent lamps containing tungsten wire filaments and gas fills. The combined action of both carbon and hydrogen together yields new and unexpected benefits in generating a means of removing reactive oxygen from the fill gas by forming inert reaction products during the life of the lamp. Such benefits are not provided by carbon or hydrogen alone. Varied sources of oxygen in the system include oxides such as $WO_3$, which can form on the tungsten filament during manufacturing and then dissociate when the lamp is turned on, yielding reactive gaseous oxygen. In addition, the ambient gas may contain oxygen from residual air, as well as from water vapor degassed from glass surfaces. Although it had been known to the prior art that carbon had potential value as a getter, see, for example, U.S. Pat. No. 1,600,203, it was not known that hydrogen enhances the effect of carbon and is, for all practical purposes, essential thereto. The reason is that carbon per se is nonvolatile at the relatively low temperatures (about 600° K. or less) of the bulb and fill gas in the typical incandescent lamp and thus deposits as an inert solid on the bulb wall. Hydrogen performs the vital function of transferring and retaining carbon in the gaseous phase by means of reactions which can be generically summarized as:

$$C(s)+x/2H_2(g)=CH_x(g), \quad (1)$$

where s means solid and g means gas. The resulting increases in the quantity of avilable chemically reactive carbon thus facilitate gettering in the lamp by reactions which become increasingly important as the temperature increases toward that of the filament, and which can be listed as:

$$CH_x(g)=C(g)+xH(g) \quad (2)$$

$$C(g)+O(g)=CO(g) \quad (3)$$

$$C(g)+OH(g)=CO(g)+\tfrac{1}{2}H_2(g) \quad (4)$$

$$C(g)+NO(g)=CO(g)+\tfrac{1}{2}N_2(g) \quad (5)$$

$$C(g)+CO_2(g)=2CO(g) \quad (6)$$

Increasing quantities of hydrogen thus can, in the presence of carbon, act as an essential component of a gettering system which inhibits oxidation of the filament by tying up chemically available oxygen in the form of CO, which is stable and essentially inert at the filament temperature, typically about 2,750° K.

This represents the first known application of the interrelated effects of hydrogen with carbon on lamp filament volatilization. The mechanism whereby hydrogen can have beneficial effects in combination with carbon is a new contribution to understanding the factors controlling incandescent lamp life.

In order to explain the invention, it is necessary to introduce a parameter, $R_W$, describing the contribution of oxidation to the volatilization of tungsten from the filament. A thermochemical approach, involving a computer program, was used to determine the theoretical equilibrium concentrations of all possible atomic and molecular species, including both reactants and reaction products, within the system. The system employed here comprises the fill gas of a 100 W/120V/A19 incandescent lamp and was defined by the bulb volume (approximately 130 cc), the temperatures of the filament (2750° K.) and fill gas (400° K.), and the quantities of those elements (W,O,H,C,N and P) specified.

The relative contribution of oxidation to the total rate of vlatilization of the tungsten filament can be represented by the equilibrium concentrations of gaseous species at the filament. For convenience and to facilitate delineation of the invention, this is represented by a ratio, $R_W$, of the total concentrations of all tungsten oxides plus that of elemental atomic tungsten to the latter in the gaseous state.

Thus, $R_W=\Sigma^C W_i n_i/n_w$, in which $\Sigma^C W_i n_i$ is the sum of the mole fractions ($n_i$) of all gaseous tungsten-containing species, adjusted for the number ($^C W_i$) of tungsten atoms per mole, and $n_w$ is the mole fraction of gaseous elemental tungsten. Thus, $R_W$ equals 1.0 where physical evaporation is the only removal mechanism, and $R_W$ is greater than 1.0 where oxidation enhances removal of tungsten from the filament. For example, mass spectrometric analysis of lamp fill gas and emission spectrographic analysis of tungsten wire show that the fill gas and the bulb walls of a typical lamp may comprise $1\times10^{-8}$ gm carbon, corresponding to 0.3 ppm (part per million) of the typical filament mass of 35 mg, $1\times10^{-7}$ gm hydrogen, $3.5\times10^{-6}$ gm tungsten corresponding to 100 ppm of the filament and $1\times10^{-6}$ gm oxygen. The carbon comes from the filament, the hydrogen from the glass bulb and stem as water vapor, the tungsten and balance of the oxygen from tungsten oxides, which were formed on the filament during sealing of the bulb to the flare. In this system, with the filament on and the bulk of the fill gas assumed to be at the same temperature as the bulb (400° K.), $R_W$ equals 36.

With everything else remaining constant, an increase in carbon by two orders of magnitude to $1\times10^{-6}$ gm (30 ppm of filament), results in a decrease of $R_W$ by 86% to 4.9, thus indicating the beneficial effect of carbon in the presence of a small quantity of hydrogen. However, the full potential of carbon gettering is not yet achieved, because insufficient hydrogen is present, and therefore some of the increased carbon deposits on the bulb wall as an inert solid. Additional gaseous carbon may be obtained by further increasing only the hydrogen by an order of magnitude to $1\times10^{-6}$ gm, which brings the inert solid carbon into the gas phase by reaction (1), so that it can effectively getter oxygen by reactions (2)-(6), resulting in a further decrease of $R_W$ by 80% to 1.0, where oxidation no longer contributes to filament volatilization. Under these assumed conditions, then, the addition of a microgram of carbon, together with the same quantity of hydrogen, can completely eliminate the contribution of oxygen to volatilization of the filament and therewith decrease $R_W$ by an overall 97%. This invention then applied to lamps in which the quantity of carbon present is equivalent to about 30 ppm or more of the filament mass up to the point at which filament embrittlement occurs, and the quantity of hydrogen is at least equal to that of the carbon.

The drawing shows an incandescent lamp in accordance with this invention. The lamp comprises a tungsten filament 1 within a glass envelope 2 having the usual screw-type base 3 at its end. Filament 1 is supported on support wires 4 embedded in glass mount 5.

Envelope 1 contains an inert gas fill, usually nitrogen or argon or mixtures thereof.

In one example, filament 1 for an A19 lamp weighed 35 mg and the lamp was filled with 580 torr of 93% argon-7% nitrogen, which is equivalent to 0.0038 mole of fill gas. To provide carbon in an amount of at least 30 ppm of the filament, or 1.05 micrograms, and hydrogen in the same amount, about 22 ppm of methane and about 88 ppm of hydrogen, based on the amount of fill gas, would be added to the lamp. To add such quantities, a facility could be provided consisting of separate sources of liquid $N_2$, liquid Ar, and a gas mixture containing 2200 ppm of $CH_4$ and 8800 ppm of $H_2$ in a fill gas consisting of 93% Ar-7% $N_2$. Gases would be drawn from the two liquid sources and from the gas mixture. The gases would be passed through a gas blender to obtain the desired $Ar/N_2$ ratio and to dilute said gas mixture by a factor of 100. An advantage to forming the fill gas by this method is that at these concentrations of $CH_4$ and $H_2$, deviations in the fill concentration are less than 2%, versus deviations of 20 to 50% for gas mixtures containing components of less than 100 ppm concentration.

We claim:

1. An incandescent lamp comprising a glass envelope having a gas fill, a tungsten filament within the envelope, and getter means disposed within the envelope, said getter means comprising carbon and a gas in elemental form, said gas in elemental form being present in a quantity which enhances the gettering effect of the carbon by reacting therewith to transfer and retain the carbon in a gaseous phase, the quantity of carbon being greater than about 30 parts per million of the weight of the filament, said gas in elemental form being hydrogen and said quantity thereof being greater than 30 parts per million of the filament weight.

2. The lamp of claim 1 wherein at least part of the carbon has been added as a gas in the lamp fill.

3. The lamp of claim 1 wherein said gas is methane.

* * * * *